US005782354A

United States Patent [19]

Genix

[11] Patent Number: 5,782,354

[45] Date of Patent: Jul. 21, 1998

[54] CORRUGATED END CAP FOR ELECTRICAL PRODUCTS

[75] Inventor: Pete Genix, Austin, Tex.

[73] Assignee: Dell Computer Corporation, Round Rock, Tex.

[21] Appl. No.: 871,189

[22] Filed: Jun. 9, 1997

[51] Int. Cl.[6] ..... B65D 81/127

[52] U.S. Cl. ..... 206/320; 206/521; 206/594

[58] Field of Search ..... 206/305, 320, 206/521, 576, 586, 591, 592, 594

[56] References Cited

U.S. PATENT DOCUMENTS

| | | | |
|---|---|---|---|
| 3,957,158 | 5/1976 | Poggiali | 206/594 |
| 5,341,934 | 8/1994 | Hsu | 206/521 |
| 5,398,808 | 3/1995 | Chen et al. | 206/320 |
| 5,467,875 | 11/1995 | Sato | 206/591 |
| 5,489,062 | 2/1996 | Wagner et al. . | |

FOREIGN PATENT DOCUMENTS

| | | | |
|---|---|---|---|
| 5-51067 | 3/1993 | Japan | 206/521 |
| 2262510 | 6/1993 | United Kingdom | 206/521 |

*Primary Examiner*—Jimmy G. Foster
*Attorney, Agent, or Firm*—Haynes and Boone, L.L.P.

[57] ABSTRACT

A corrugated end cap for packaging electrical products includes a die-cut sheet of corrugated material having perforations, scores, cutouts and fold lines. The corrugated die-cut is foldable to extend a plurality of ribs and a pair of rollover shoulders. A first one of the shoulders is on a first side of the ribs and a second one of the shoulders is on a second side of the ribs. The shoulders are foldable to interlock with the ribs for forming an end cap including a cavity for engaging a portion of an electrical product. The cavity includes only flat bearing surfaces for engagement with the product. In this manner no edge portions of the material engage the product.

16 Claims, 4 Drawing Sheets

CORRUGATED END CAP FOR ELECTRICAL PRODUCTS

BACKGROUND

The disclosures herein relate generally to packaging an electrical product to be transported and more particularly to die cut corrugated end caps for blocking and bracing the electrical product by inserting opposed ends of the product into the end caps supported within a shipping container.

When an electrical product is shipped it must be packed in a shipping container in a manner which protects the product from damage. Such damage may be in the form of shock from dropping the container, from blows to the container and from crushing or deforming the container. Another type of damage is in the form of abrasion between the surface of the product and the packaging material. This can occur from rubbing or scratching which may occur between the packaging material and the product being engaged and supported by the material.

It is also possible for the product to damage the packaging material. For example, an exposed edge of the material may be subjected to contacts with the product such that degradation of the material occurs. This degradation of the packaging material can cause abrasive damage to the product. Degradation can also cause the product to become loose and ultimately subjected to increased movement with relation to the packaging material supporting the product.

The purpose of the packaging material is to block and brace the product within a shipping container. The block and brace concept achieves suspending the product within a container so that a buffer zone or space is created between the product and the container. The space preferably surrounds the product and is maintained during shipping and handling, thus protecting the product from damage and shock imposed on the container. Therefore, in order to maintain the integrity of the space, it is not only important that the container maintain its shape, but that the packaging material also maintain its shape. Thus, the material used for packaging must be lightweight and able to absorb and cushion shock. Also, the material must be economically feasible since it is essentially a disposable item. In conjunction with the material being disposable, it is beneficial to use material which is environmentally compatible.

Synthetic foam material is often used as packaging material for computer products and although foam is lightweight and absorbs shock well, it is expensive and is also very difficult to recycle.

Corrugated material is also used. It is also lightweight and can be formed to brace and block the packaged product and absorb shock. In addition, corrugated material is less expensive than synthetic foams and can be formed of recycled material and material which is environmentally recyclable. However, corrugated material, if not supported correctly, can cause abrasion to the packaged product and degradation of the corrugated material.

Therefore, what is needed is a method and apparatus for providing a lightweight, inexpensive corrugated end cap for protecting an electrical product in a shipping container, which restricts exposed edges from contact with the product, which provides only flat bearing surfaces for engaging the product in a manner which adequately supports while minimizing abrasion and degradation of the corrugated material and which is environmentally compatible.

SUMMARY

One embodiment, accordingly, provides an apparatus forming an end cap for blocking and bracing an electrical product in a shipping container, and a method of forming the end cap. To this end, a corrugated end cap for packaged products includes a corrugated member having perforations, scores, and cutouts forming fold lines. The corrugated member includes flat bearing surfaces and edge portions and is foldable to extend a plurality of ribs and a pair of rollover shoulders. A first one of the shoulders is on a first side of the ribs and a second one of the shoulders is on a second side of the ribs. The shoulders are foldable to interlock with the ribs for forming an end cap including a cavity for engaging a portion of an electrical product. The cavity includes only the flat bearing surfaces for engagement with the product. In this manner, no edge portions of the corrugated member engage the product.

A principal advantage of this embodiment is that it provides a lightweight, inexpensive corrugated end cap for protecting an electrical product in a shipping container with sufficient strength and resiliency to protect the product. The end cap restricts exposed edges from contact with the product being supported and provides only flat bearing surfaces for engaging the product in a manner which adequately supports while minimizing abrasion and which is also environmentally compatible.

DETAILED DESCRIPTION OF THE PREFERRED EMBODIMENT

Figure 1:
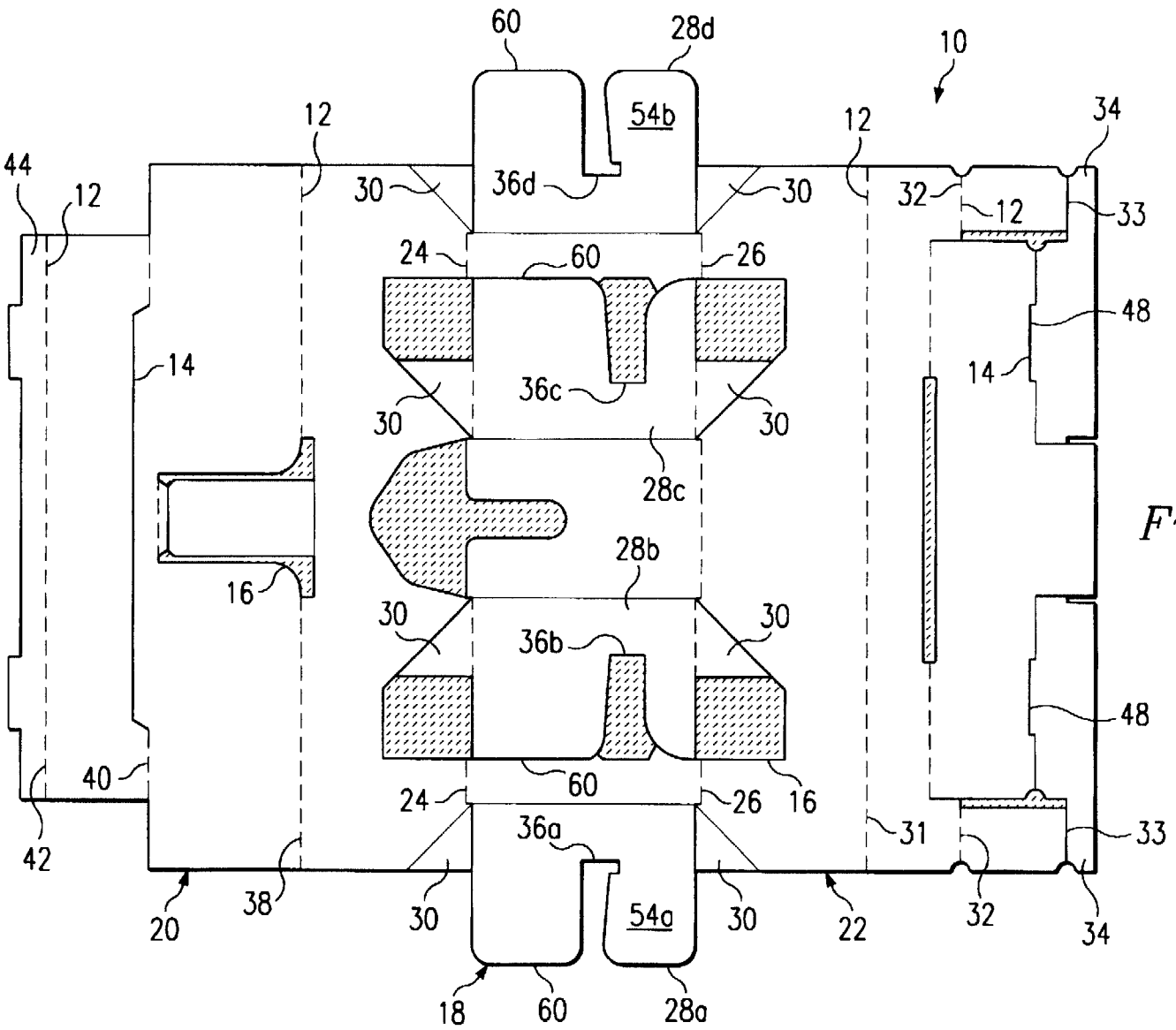
FIG. 1 is a plain view illustrating an embodiment of a knockdown die-cut from a sheet of corrugated paperboard.

A corrugated endcap for packaging electrical products is formed from a flat sheet of corrugated material which is die-cut from the sheet of corrugated material 10, FIG. 1. In the die-cutting operation, the corrugated material 10 is formed resulting in various combinations of perforations 12, scores 14 and cutouts 16 which combine to form fold lines to permit the corrugated die-cut material 10 to be folded and determine the desired end cap configuration. The cut outs 16 are removable prior to folding and are indicated in FIG. 1 by the cross-hatched areas.

As it is well known, corrugated paperboard is formed by a fluted member sandwiched between two planar face sheets and held together by an adhesive. The planar face sheets form smooth bearing surfaces whereas edge portions of the corrugated paperboard, which are perpendicular to the bearing surfaces, are not smooth due to the cross-sectional exposure of the fluted member and the adjacent face sheets.

In accordance with one embodiment, the corrugated die-cut 10 is formed with three basic sections. The sections include a center section 18 and a pair of rollover shoulder sections 20, 22, i.e, a first shoulder section 20 on one side of the center section 18 and a second shoulder section 22 on the other side of center section 18. The shoulder sections 20, 22 are formed to fold upwardly and wrap around the center section 18, as will be discussed in greater detail.

Shoulder 20 is primarily folded upwardly at a fold line 24 at an interface between shoulder 20 and center section 18.

Figure 2:
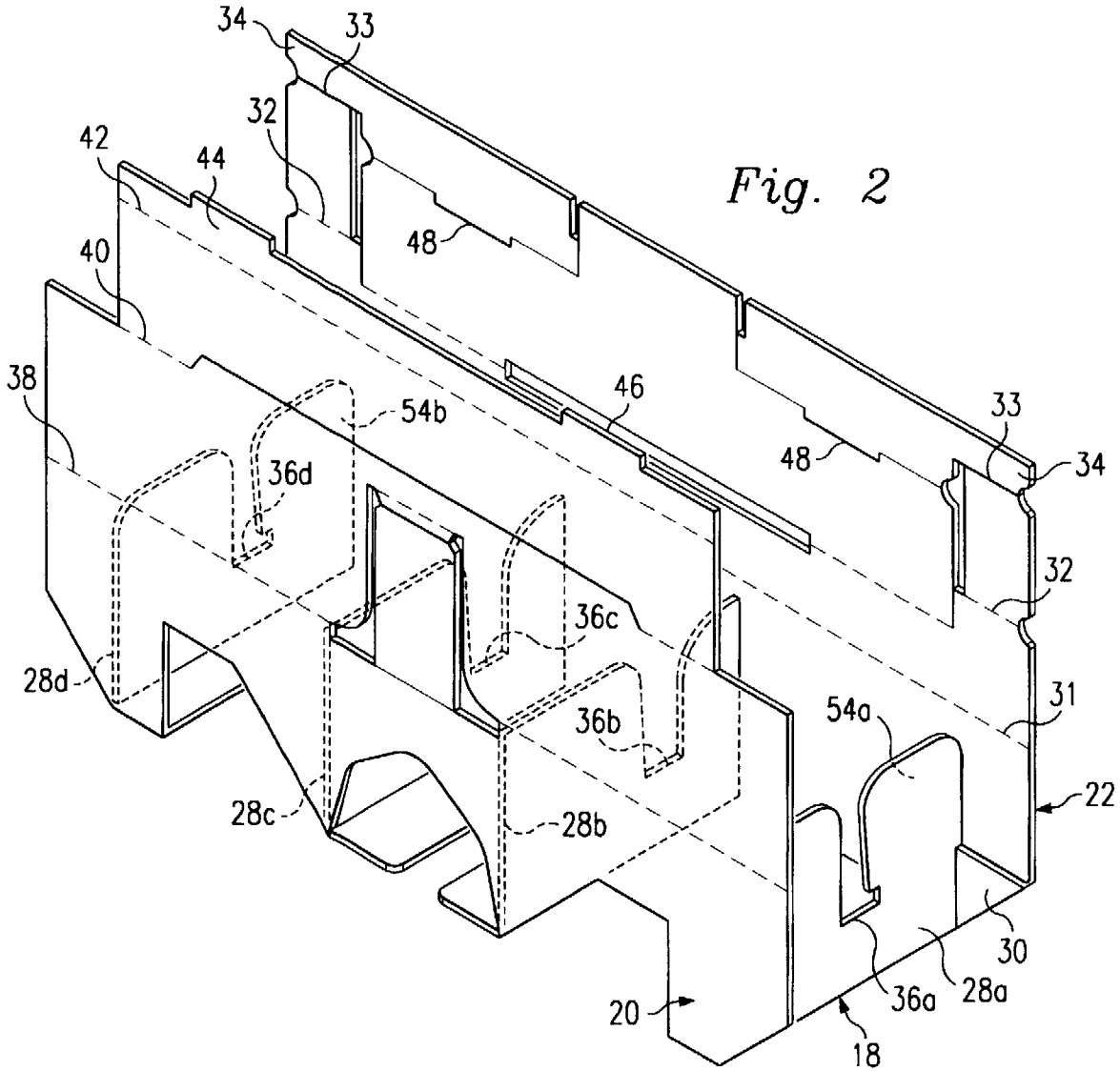
FIG. 2 is an isometric view illustrating an embodiment of the knockdown of FIG. 1 in a partially folded position.

Shoulder 22 is primarily folded upwardly at a fold line 26 at an interface between shoulder 22 and center section 18. In response to shoulders 20, 22 being folded upwardly at fold lines 24, 26, a plurality of ribs 28*a*, 28*b*, 28*c* and 28*d*, of center section 18, are preformed to extend upwardly from center section 18, see also, FIG. 2. The upward extension of ribs 28*a*, 28*b*, 28*c* and 28*d* is prompted by the corner fold sections 30 adjacent each of the ribs 28*a*, 28*b*, 28*c*, 28*d*.

Figure 3:
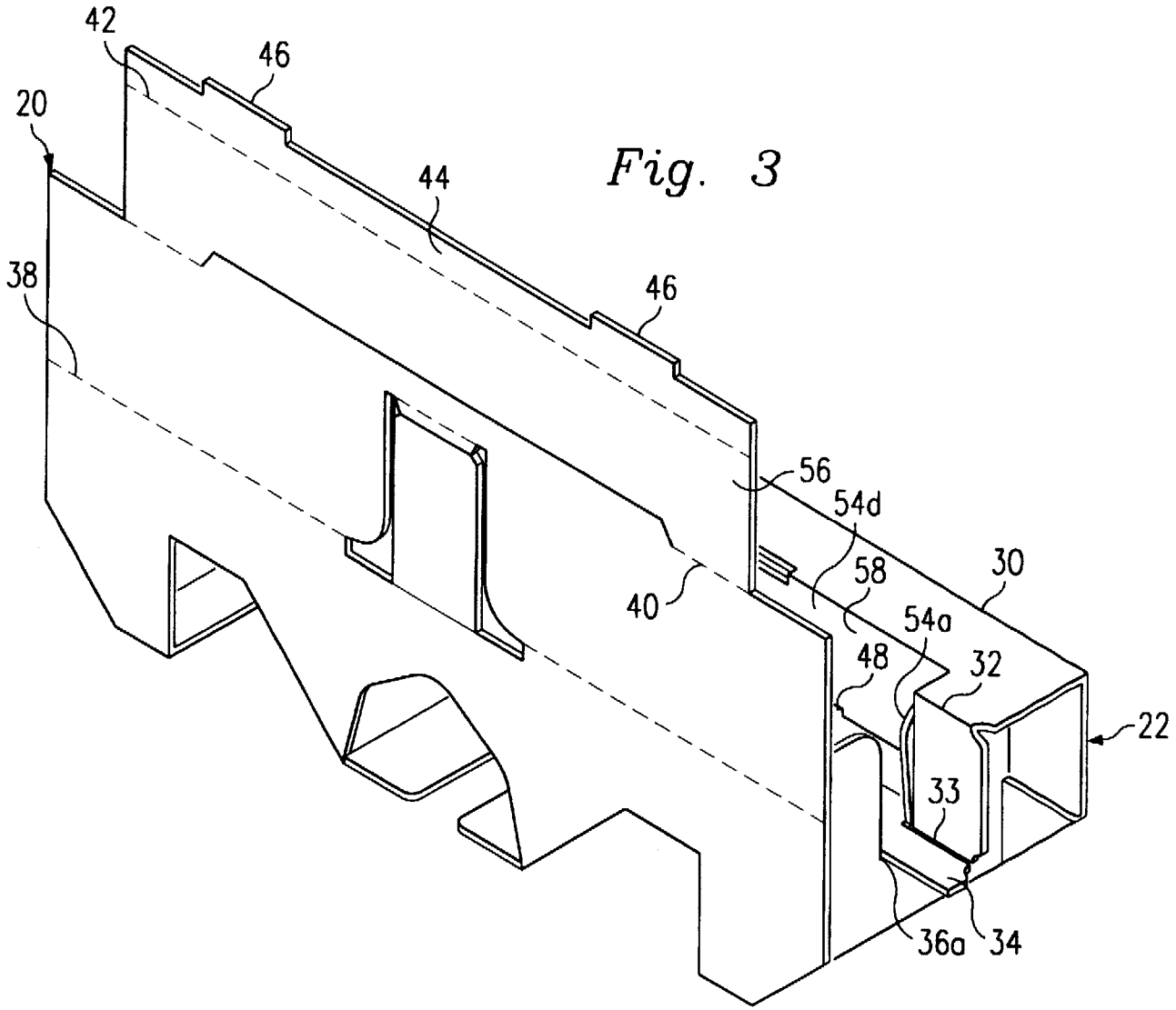
FIG. 3 is an isometric view illustrating the knockdown of FIG. 1 in a further partially folded position.
Figure 4:
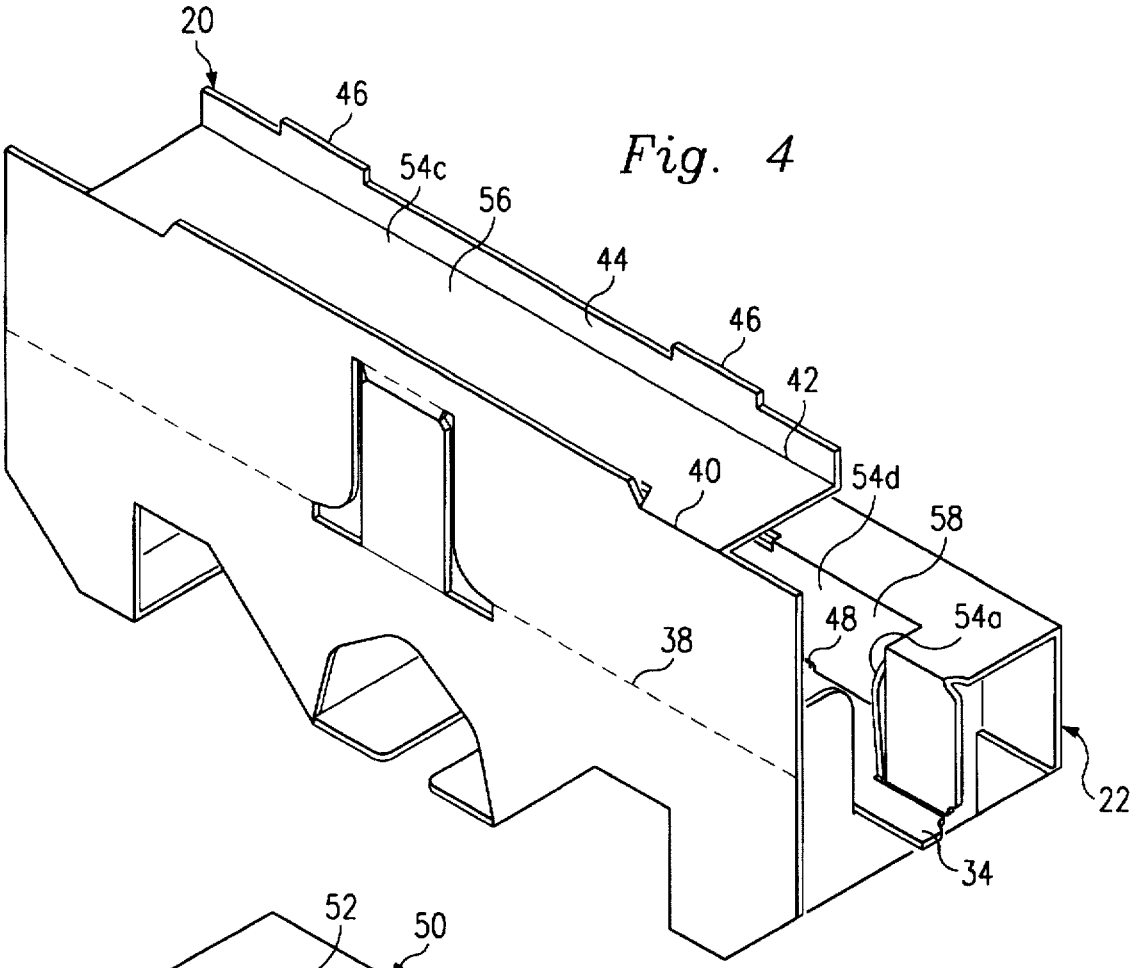
FIG. 4 is an isometric view illustrating the knockdown of FIG. 1 in a still further partially folded position.

At this point, with ribs 28*a*, 28*b*, 28*c*, 28*d* extended upwardly, and shoulders 20, 22 folded upwardly at fold lines 24, 26, respectively, on opposite sides of center section 18, shoulders 20, 22 are in position to be folded to frictionally interlock with ribs 28*a*, 28*b*, 28*c*, 28*d* and form the end cap. It can be seen by referring to FIGS. 1–3, that shoulder 22 is preformed to fold at multiple folds 31, 32, 33 so that a section 34 is seated in a groove portion 36*a*, 36*b*, 36*c*, 36*d*, respectively, formed in each rib 28*a*, 28*b*, 28*c*, 28*d*. It can also be seen by referring to FIGS. 1–4, that shoulder 20 is preformed to fold at multiple folds 38, 40, 42 so that a section 44 is seated in groove portions 36*a*, 36*b*, 36*c*, 36*d* in stacked relationship, FIG. 5, with section 34 of shoulder 22. A pair of tabs 46 on section 44 are inserted into receiving slits 48 formed in fold line 33. Receiving slits 48 open to receive tabs 46 when section 34 is folded at fold line 33 as shown in FIGS. 3 and 4. When section 44 is seated in stacked relationship with section 34, tabs 46 are inserted in slits 48.

Figure 5:
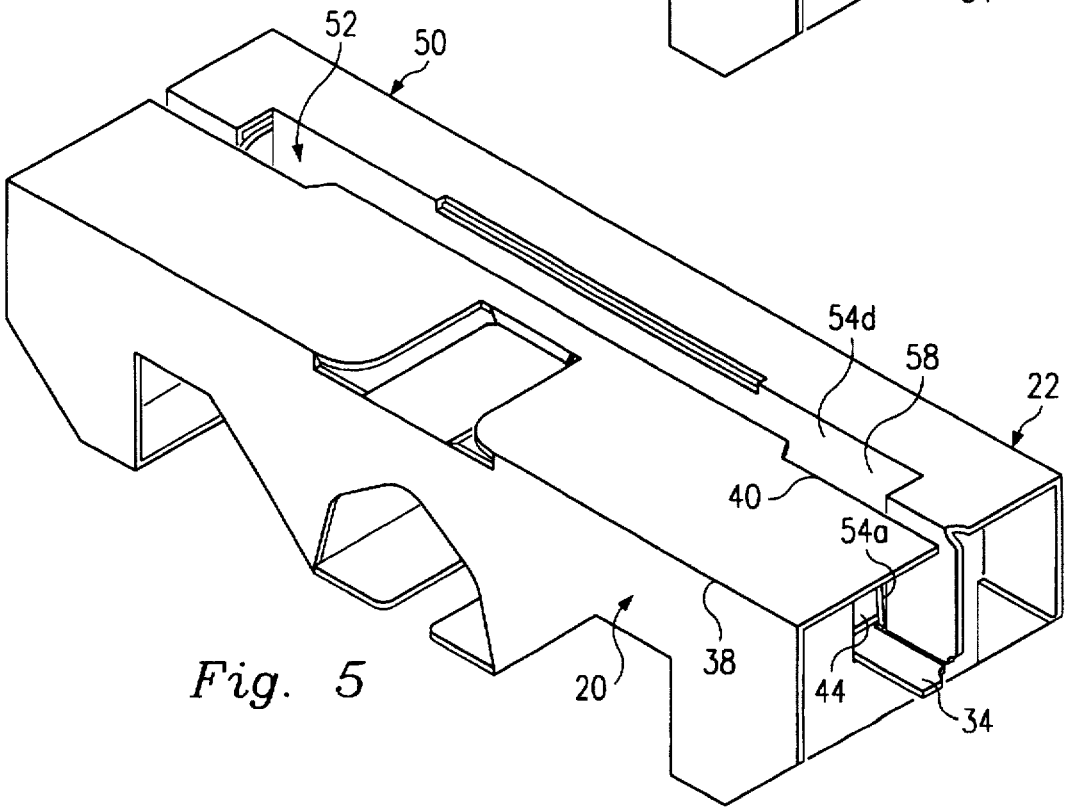
FIG. 5 is an isometric view illustrating the knockdown of FIG. 1 in a fully folded position forming an endcap having a cavity therein.

With shoulders 20, 22 folded as illustrated in FIG. 5, interlocked with ribs 28*a*, 28*b*, 28*c*, 28*d*, end cap 50 is formed including a cavity 52. All surfaces of cavity 52 are defined by four flat bearing surfaces 54*a*, 54*b*, 54*c*, 54*d* so that no edge portions are engaged by the product to be captured in cavity 52. Two of the bearing surfaces 54*a*, 54*b* are at opposed ends of cavity 52 and are formed by sections of ribs 28*a*, 28*d*, respectively, see FIGS. 1–5. The other two of the bearing surfaces 54*c*, 54*d* are at opposed sides of cavity 52 and are respectively formed by section 56 of shoulder 20 and section 58 of shoulder 22, FIGS. 3–5.

Some of the bearing surfaces are formed by the ribs and some of the bearing surfaces are formed by the shoulders as described above. In this manner, the smooth bearing surfaces 54*a–d* are used to define cavity 52 which captures the electrical product being supported by the cavity. Also, the folds occur so that edge portions 60, FIG. 1 of the knock-down 10 are not exposed to contact with the product captured in cavity 52.

The portion of the electrical product being received in and captured by the cavity may vary. For example, it may be required to provide a first end cap for supporting a first end of the product and a second end cap for supporting a second end of the product. The first and second ends of the product may not be the same in shape or size. Therefore, the cavity shape and size in the first end cap is required to be different from the cavity shape and size in the second end cap. In that case, all that is required is that the corrugated die-cut for the first end cap be provided to form the first cavity shape and size and the corrugated die-cut for the second end cap be provided to form the second cavity shape and size. This can be accomplished so that each end cap is formed with the basic center section including ribs and a pair of shoulder sections as described above. Adjustments in the perforations, scores and cutouts will combine to determine the fold lines required to permit the corrugated die-cut to the folded in the desired end cap configuration.

As it can be seen, the principal advantages of the corrugated end cap illustrated by the embodiments herein, are that it provides a method and apparatus for a lightweight, inexpensive end cap for protecting an electrical product in a shipping container, which restricts exposed edges from contact with the product, which provides only flat bearing surfaces for engaging the product in a manner which adequately supports while minimizing abrasion and degradation of the corrugated material, and which is environmentally compatible.

Although illustrative embodiments have been shown and described, a wide range of modifications, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A corrugated end cap for packaged products comprising:

a corrugated member including perforations, scores and cutouts, the corrugated member having flat bearing surfaces and a center section positioned between a first rollover shoulder section spaced apart from a second rollover shoulder section;

a first fold line formed between the center section and the first rollover shoulder section, a second fold line formed between the center section and the second rollover shoulder section:

a plurality of spaced apart ribs formed in the center section;

said corrugated member being foldable at the first and second fold lines to extend the spaced apart ribs and the spaced apart pair of rollover shoulder sections;

a first one of the rollover shoulder sections including a tab and being on a first side of the ribs and second one of the rollover shoulder sections including a slit and being on a second side of the ribs, the first and second rollover shoulder sections each having multiple folds formed therein;

the rollover shoulder sections being foldable at their respective multiple folds to interlock the tab and the slit and engage with the extended ribs for forming an end cap including an open ended cavity for engaging a portion of an electrical product; and the cavity being defined by the flat bearing surfaces including opposed side walls and a base wall formed by portions of the rollover shoulder sections and including opposed end walls formed by two of the ribs for engagement with the product, the bearing surfaces of the two ribs each having an opening formed therein, and one of the portions of the rollover shoulder sections extending through the open end of the cavity.

2. The end cap as defined in claim 1 wherein the ribs include grooves formed therein for receiving the shoulder sections.

3. The end cap as defined in claim 2 wherein the ribs are extended perpendicular to the extended shoulder sections.

4. The end cap as defined in claim 2 wherein the ribs are parallel to each other.

5. The end cap as defined in claim 1 wherein the bearing surfaces formed by the ribs are perpendicular to the bearing surfaces formed by shoulder sections.

6. The end cap as defined in claim 1 wherein the bearing surfaces are planar.

7. The end cap as defined in claim 1 wherein the corrugated member is die cut.

8. The end cap as defined in claim 1 wherein the cavity includes opposed parallel sides.

9. A die-cut corrugated end cap for packaged electrical products comprising:

a corrugated member including perforations, scores and cutouts, the corrugated member having planar bearing surfaces, said corrugated member having a center section positioned between a fist rollover shoulder section spaced apart from a second rollover shoulder section;

a first fold line formed between the center section and the first rollover shoulder section;

a second fold line formed between the center section and the second rollover shoulder section, a plurality of spaced apart ribs formed in the center section, said corrugated member being foldable at the first and second fold lines to extend the spaced apart ribs having grooves formed therein and the spaced apart pair of rollover shoulder sections;

a first one of the rollover shoulder sections including a tab and being on a first side of the ribs and a second one of the rollover shoulder sections including a slit and being on a second side of the ribs, the first and second rollover shoulder sections each having multiple folds formed therein;

the rollover shoulder sections being foldable at their respective multiple folds to interlock the tab and the slit and engage with the grooves formed in the extended ribs for forming an end cap including an open ended cavity for engaging a portion of an electrical product; and the cavity being defined by the planar bearing surfaces including opposed side walls and a base wall formed by portions of said rollover shoulder sections and including opposed end walls formed by two of the ribs for engagement with the product, the bearing surfaces of the two ribs each having an opening formed therein by the grooves, and one of the portions of the rollover shoulder sections extending through the open ended cavity.

10. The end cap as defined in claim 9 wherein the ribs include grooves formed therein for receiving the shoulder sections.

11. The end cap as defined in claim 10 wherein the ribs are extended perpendicular to the extended shoulder sections.

12. The end cap as defined in claim 10 wherein the ribs are parallel to each other.

13. The end cap as defined in claim 9 wherein the cavity includes opposed parallel sides.

14. A method of forming a corrugated end cap for packaging electrical products comprising the steps of:

perforating, scoring and cutting a corrugated member having first and second fold lines, planar bearing surfaces and a center section positioned between a first rollover shoulder section having multiple folds and a tab spaced apart from a second rollover shoulder section having multiple folds and a slit;

folding said corrugated member along the first fold line between the center section and the first rollover shoulder section and along the second fold line between the center section and the second rollover shoulder section for extending a plurality of spaced apart ribs, each including a groove formed therein, from the center section; and folding the rollover shoulder sections at their respective multiple folds to interlock the tab and the slit and engage with the extended ribs for forming an end cap including an open ended cavity for engaging a portion of an electrical product, so that said cavity is defined by the bearing surfaces including spaced apart end walls formed by at least two of the ribs and spaced apart side walls and a base formed by portions of the rollover shoulder sections for engagement with the product, one of the portions of the rollover shoulder sections extending through the open ended cavity.

15. The method as defined in claim 14 wherein the step of folding the shoulder sections includes the step of interlocking the shoulder sections perpendicular to ribs.

16. The method as defined in claim 14 wherein the step of folding the shoulder sections includes the step of forming the cavity so that the shoulder sections interlock with the grooves formed in the ribs.

* * * * *

UNITED STATES PATENT AND TRADEMARK OFFICE

CERTIFICATE OF CORRECTION

PATENT NO. : 5,782,354

DATED : July 21, 1998

INVENTOR(s) : Pete Genix

It is certified that error appears in the above-identified patent and that said Letters Patent is hereby corrected as shown below:

Col. 2, line 26, "plain view" should be --plan view--.

Signed and Sealed this

Twentieth Day of October, 1998

*Attest:*

*Attesting Officer*

BRUCE LEHMAN

*Commissioner of Patents and Trademarks*